US009174454B2

(12) United States Patent
Tsujiuchi et al.

(10) Patent No.: US 9,174,454 B2
(45) Date of Patent: Nov. 3, 2015

(54) LIQUID EJECTION HEAD AND LIQUID EJECTION APPARATUS

(75) Inventors: Naoko Tsujiuchi, Kawasaki (JP); Kiyomitsu Kudo, Machida (JP); Tomotsugu Kuroda, Yokohama (JP); Yosuke Takagi, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 13/215,551

(22) Filed: Aug. 23, 2011

(65) Prior Publication Data

US 2012/0050418 A1 Mar. 1, 2012

(30) Foreign Application Priority Data

Aug. 26, 2010 (JP) ..... 2010-189455

(51) Int. Cl.
*B41J 2/175* (2006.01)
*B41J 29/02* (2006.01)

(52) U.S. Cl.
CPC ..... *B41J 2/17509* (2013.01); *B41J 2/1752* (2013.01); *B41J 2/17513* (2013.01); *B41J 29/02* (2013.01)

(58) Field of Classification Search
USPC ..... 347/84–87
See application file for complete search history.

(56) References Cited

U.S. PATENT DOCUMENTS

| | | | | |
|---|---|---|---|---|
| 6,120,136 | A | 9/2000 | Sugiyama | |
| 6,866,374 | B2 * | 3/2005 | Taku | 347/86 |
| 7,063,409 | B2 * | 6/2006 | Koga | 347/85 |
| 7,425,059 | B2 * | 9/2008 | Kudo et al. | 347/85 |
| 7,469,992 | B2 * | 12/2008 | Suzuki et al. | 347/49 |
| 8,042,921 | B2 * | 10/2011 | Kimura et al. | 347/84 |
| 8,113,639 | B2 * | 2/2012 | Kimura et al. | 347/86 |
| 2006/0232647 | A1 * | 10/2006 | Suzuki et al. | 347/86 |
| 2006/0284944 | A1 * | 12/2006 | Kudo et al. | 347/85 |
| 2008/0151020 | A1 * | 6/2008 | Kimura et al. | 347/86 |
| 2009/0201354 | A1 | 8/2009 | Akiyama | |
| 2013/0070032 | A1 * | 3/2013 | Sekino et al. | 347/84 |

FOREIGN PATENT DOCUMENTS

| | | | |
|---|---|---|---|
| CN | 1170663 | A | 1/1998 |
| CN | 101152789 | A | 4/2008 |
| JP | 2004-074782 | A | 3/2004 |
| JP | 2008-137376A | A | 6/2008 |
| JP | 2008-254187A | A | 10/2008 |

* cited by examiner

*Primary Examiner* — Matthew Luu
*Assistant Examiner* — Lily Kemathe
(74) *Attorney, Agent, or Firm* — Canon U.S.A., Inc. IP Division

(57) ABSTRACT

A liquid ejection apparatus includes a liquid supply member having a plurality of liquid supply passages, a connecting surface having a plurality of connecting portions connected to the liquid supply passages, a first positioning portion configured to determine relative positions between the liquid supply passages and the connecting portions in one direction along the connecting surface, and a second positioning portion configured to determine relative positions between the liquid supply passages and the connecting portions in the one direction and an other direction perpendicular to the one direction. A first distance between centers of gravity of the first positioning portion and the connecting portion farthest from the first positioning portion is longer than a second distance between centers of gravity of the second positioning portion and the connecting portion farthest from the second positioning portion.

19 Claims, 9 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus that eject liquid.

2. Description of the Related Art

In an inkjet recording apparatus serving as a typical liquid ejection apparatus, an off-carriage system and an on-carriage system are used to supply ink to an inkjet head. In an off-carriage system, an inkjet head is provided with a portion that stores ink (hereinafter also referred to as a sub-tank), via which ink is supplied to the inkjet head from an ink tank that is not mounted on a carriage (hereinafter also referred to as a main tank). In contrast, in an on-carriage system, an ink tank is mounted together with an inkjet head on a carriage, and ink is supplied from the ink tank to the inkjet head, not via a sub-tank.

When a large number of ink colors are used, or when a large-capacity ink tank is used, heavy weight is put on the carriage in the on-carriage system. In such a case, it is more advantageous to use the off-carriage system.

One way to supply ink from the main tank to the inkjet head in the off-carriage system is to use an ink supply tube that is connected at one end to the main tank and at the other end to the inkjet head. The ink supply tube and the inkjet head are connected by their respective joint portions (connecting portions). In this case, if the joint portion of the tube and the joint portion of the head are connected although they are misaligned, ink leakage may occur at the joint portions. For this reason, it is necessary to position the joint portions accurately.

Japanese Patent Laid-Open No. 2004-74782 discloses a structure for positioning joint portions. In this disclosed structure, as illustrated in FIG. 10, a first member has two positioning pins, and a second member 89 has a circular hole 89*d* and a slotted hole 89*e* at positions corresponding to the two positioning pins of the first member. The positioning pins and the holes are fitted together to form positioning portions, which determine the relative position between the members.

Recent inkjet recording apparatuses intended to print photographs sometimes use multiple ink colors in order to realize high image quality. Correspondingly, the number of ink supply tubes and the number of joint portions (connecting portions) to be connected to the ink supply tubes increase. When the number of joint portions is large, a joint portion area where the joint portions are arranged is wide. In general, as the size of a component increases, it becomes more difficult to increase the dimensional accuracy. Thus, the dimensional tolerance of the component increases. Therefore, as the joint portion area is widened, the distances from the positioning portions to the joint portions increase, and the dimensional tolerance also increases. If a sufficient positioning accuracy is not ensured, ink leakage may occur at the joint portions. However, a sufficient consideration has not hitherto been given to the positional accuracy for a large number of joint portions.

SUMMARY OF THE INVENTION

Accordingly, the present invention provides a structure including a member having a plurality of supply passages configured to supply liquid and a member having a plurality of connecting portions connected to the supply passages, in which the risk of liquid leakage at the connecting portions is reduced by accurately determining the relative positions between the supply passages and the connecting portions.

A liquid ejection apparatus according to an aspect of the present invention includes a liquid supply member having a plurality of liquid supply passages configured to supply liquid to be ejected from the liquid ejection apparatus; a connecting surface having a plurality of connecting portions connected to the plurality of liquid supply passages; a first positioning portion configured to determine relative positions between the plurality of liquid supply passages and the plurality of connecting portions in one direction along the connecting surface; and a second positioning portion configured to determine relative positions between the plurality of liquid supply passages and the plurality of connecting portions in the one direction and an other direction perpendicular to the one direction, along the connecting surface. A first distance between a center of gravity of the first positioning portion in a direction along the connecting surface and a center of gravity of the connecting portion in the direction along the connecting surface, farthest from the first positioning portion of the plurality of connecting portions, is longer than a second distance between a center of gravity of the second positioning portion in the direction along the connecting surface and a center of gravity of the connecting portion in the direction along the connecting surface, farthest from the second positioning portion of the plurality of connecting portions.

According to the aspect of the present invention, the risk of liquid leakage at the connecting portions can be reduced by accurately determining the relative positions between the connecting portions and the supply passages.

Further features of the present invention will become apparent from the following description of exemplary embodiments with reference to the attached drawings.

BRIEF DESCRIPTION OF THE DRAWINGS

FIG. 3A is a perspective view of the joint member including a surface to be connected to the inkjet head, FIG. 3B illustrates a joint surface of a tank holder, and FIG. 3C is a cross-sectional view, taken along line IIIC-IIIC of FIG. 3B, illustrating a state in which the inkjet head and the joint member are connected.

FIGS. 5A to 5C2 illustrate positional deviation of a joint opening in the rotating direction due to a first positioning portion.

DESCRIPTION OF THE EMBODIMENTS

First Embodiment

Figure 1:
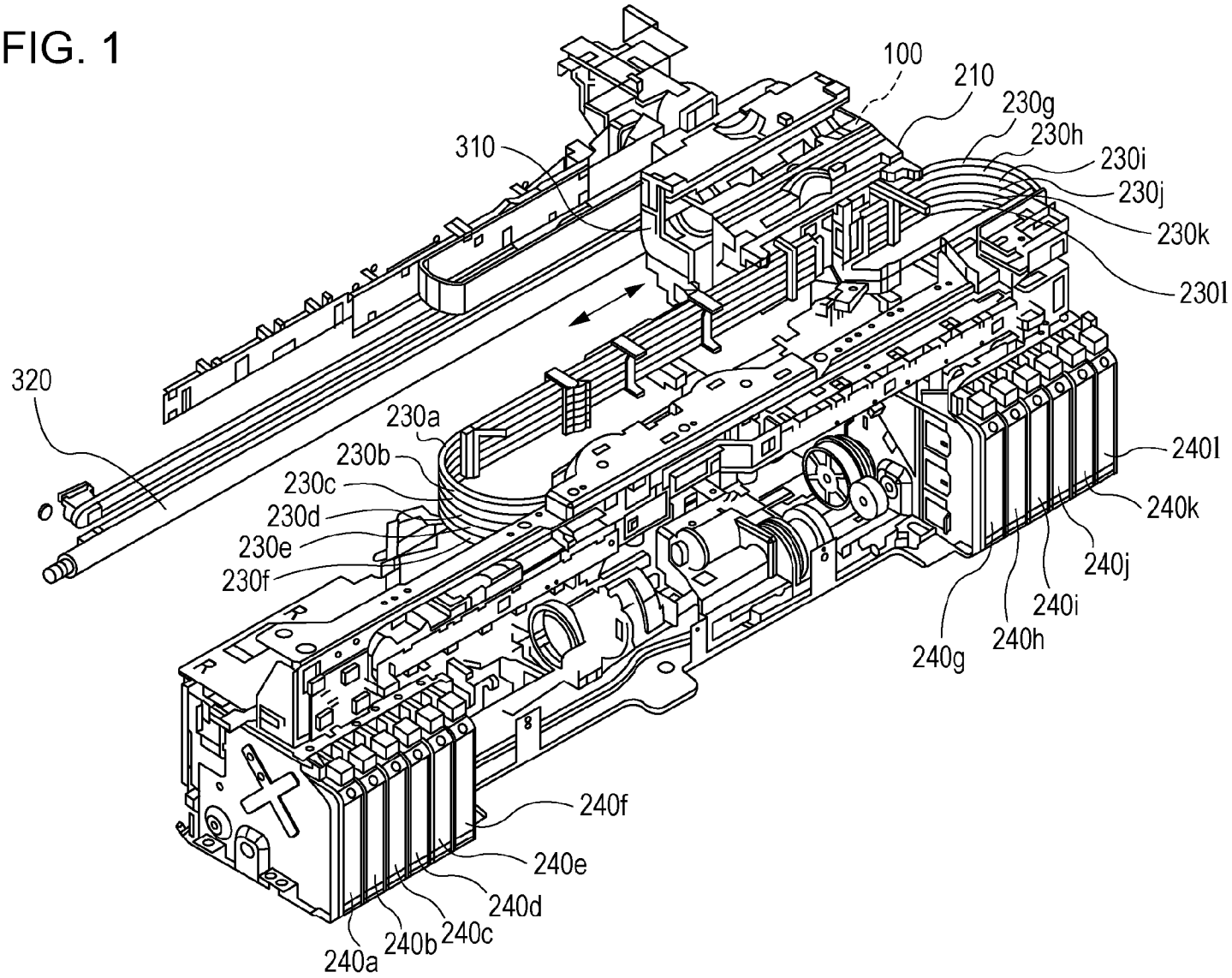
FIG. 1 is a perspective view illustrating a part of an inkjet recording apparatus according to a first embodiment of the present invention.

FIG. 1 schematically illustrates a part of an inkjet recording apparatus serving as a liquid ejection apparatus according to a first embodiment. An inkjet head 100 functions as a liquid ejection head and is mounted in a carriage 310. The carriage 310 is scanned along a shaft 320 in a direction perpendicular to a paper feed direction (direction of the arrow in FIG. 1), thereby forming an image.

In the first embodiment, twelve color inks are stored in twelve main tanks 240 (240*a* to 240*l*), and are supplied from the main tanks 240 to the inkjet head 10 through ink supply tubes 230 (230*a* to 230*l*). Ends of the ink supply tubes 230 to be connected to the inkjet head 100 are connected to a joint member 210 fixed to the carriage 310.

Figure 2:
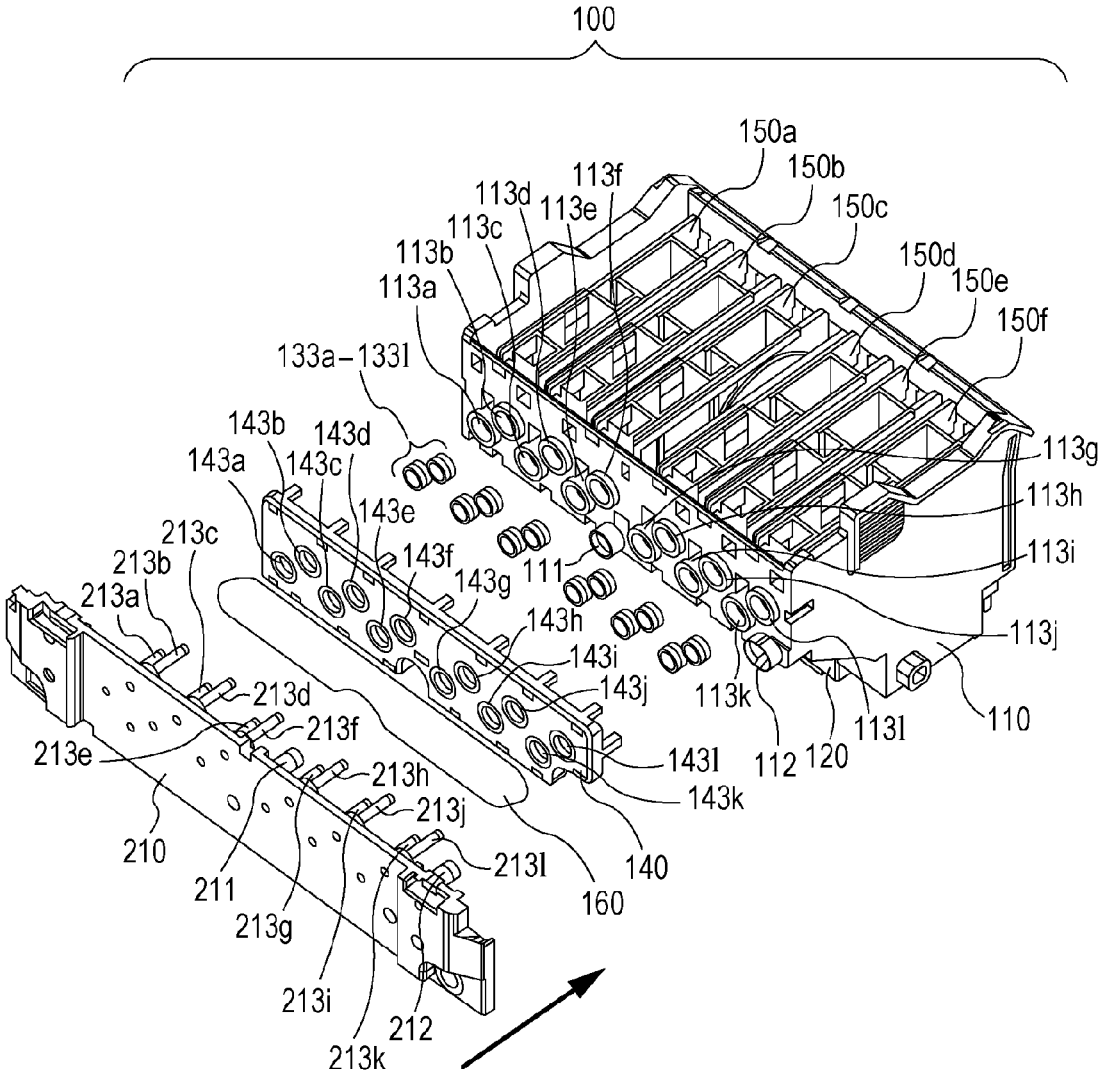
FIG. 2 is an exploded perspective view of an inkjet head and a joint member in the first embodiment.
Figure 3A:
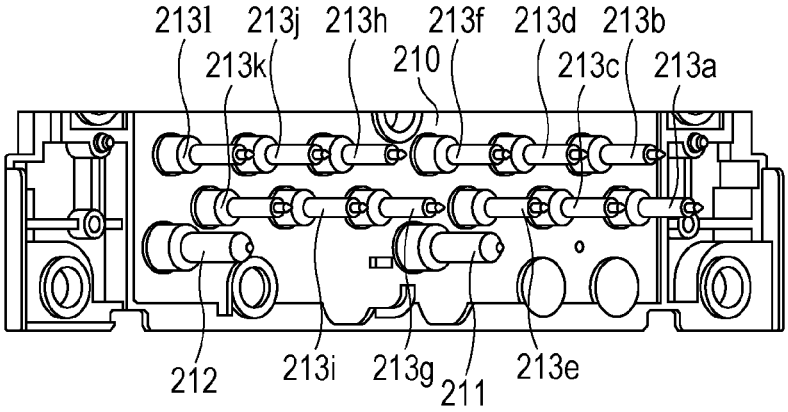
FIGS. 3A to 3C illustrate joint sections in the first embodiment.
Figure 3B:
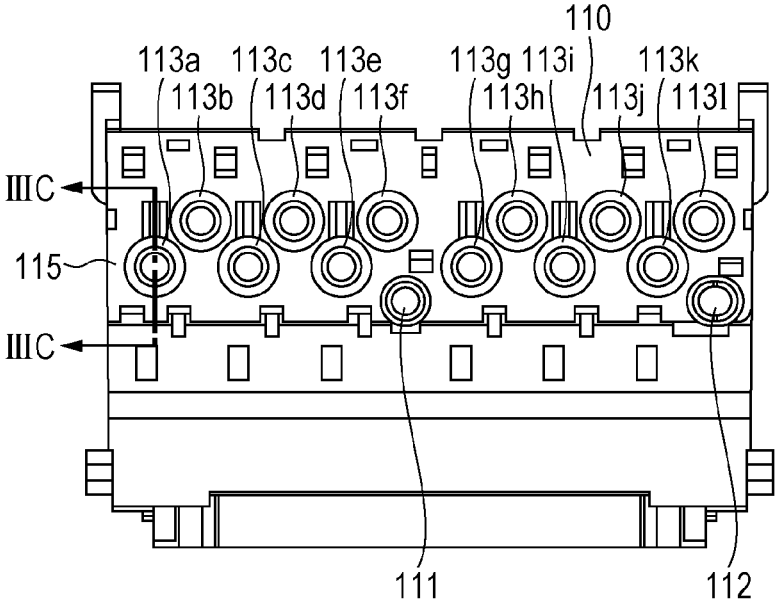
Figure 3C:
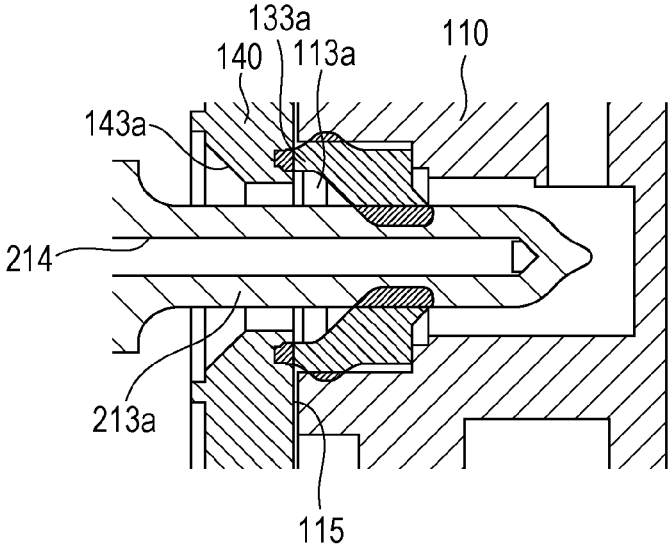

The inkjet head 100 and the joint member 210 will be described below with reference to FIGS. 2 and 3. FIG. 2 is an exploded perspective view of the inkjet head 100 and the joint member 210. FIG. 3A is a perspective view of the joint member 210 including a surface to be connected to the inkjet head 100. FIG. 3B illustrates a surface of a tank holder 110 to be connected to the joint member 210. FIG. 3C is a cross-sectional view, taken along line IIIC-IIIC of FIG. 3B, illustrating a state in which the inkjet head 100 and the joint member 210 are connected.

The joint member 210 serves as a liquid supply member, and has joint needles 213 (213*a* to 213*l*) serving as liquid supply passages that communicate between the ink supply tubes 230 and the inkjet head 100. Each of the joint needles 213 has an opening 214 extending from a proximal end to a distal end. A proximal-end portion of the opening 214 is connected to the corresponding ink supply tube 230, and ink is supplied from a distal-end portion of the opening 214 to the inkjet head 100 (see FIG. 3C). The joint member 210 also has a second positioning pin 211 and a first positioning pin 212 for determining the relative positions between the joint needles 213 (213*a* to 213*l*) and joint openings 113 (113*a* to 113*l*). The two positioning pins 211 and 212 are longer than the joint needles 213.

The inkjet head 100 includes a tank holder 110, an ink ejection unit 120, needle seals 133 (133*a* to 133*l*), a joint cover 140, sub-tanks 150 (150*a* to 150*f*), and a joint film 160. These components will be described below.

A joint surface 115 serving as a connecting surface of the tank holder 110 has joint openings 113*a* to 113*l* serving as connecting portions. The joint openings 113*a* to 113*l* are provided at positions corresponding to the joint needles 213 (213*a* to 213*l*). Ink flows from the joint needles 213 into sub-tanks 150 (150*a* to 150*f*) through flow passages provided in the tank holder 110. The sub-tanks 150 have a capacity smaller than that of the main tanks 240, and are provided in the tank holder 110 to store ink. Each sub-tank 150 can store inks of two colors. The ink stored in the sub-tanks 150 is supplied through the flow passages of the tank holder 110 to the ink ejection unit 120, from which the ink is ejected for printing.

A description will be given of a structure of joint portions provided in the inkjet head 100, in which the joint needles 213 are inserted.

Ring-shaped needle seals 133 (133*a* to 133*l*) are provided on the inner sides of the joint openings 113 (113*a* to 113*l*) of the tank holder 110. By attaching the joint cover 140 to the tank holder 110, the needle seals 133 are fixed in the joint openings 113. The joint cover 140 has joint openings 143 (143*a* to 143*l*) at positions corresponding to the joint openings 113 of the tank holder 110. The joint film 160 is welded on a surface of the joint cover 140 facing the joint member 210. During distribution, the inkjet head 100 of the first embodiment is set in a state in which the flow passages in the tank holder 110 and the sub-tanks 150 are filled with distribution ink. Accordingly, the joint film 160 is welded to surround the rims of the joint openings 143 of the joint cover 140 so as to reduce the risk of ink leakage from the joint openings 143 during distribution.

A second positioning opening 111 and a first positioning opening 112 are provided at positions in the joint surface 115 of the tank holder 110 corresponding to the positioning pins 211 and 212 provided on the joint member 210. The second positioning opening 111 is a circular hole and has almost the same diameter as that of the second positioning pin 211. The first positioning opening 112 is a slotted hole, and a minor diameter thereof is substantially equal to the diameter of the first positioning pin 212. The functions of these shapes will be described below.

Next, connection between the inkjet head 100 and the joint member 210 will be described. By mounting the inkjet head 100 in the carriage 310 and sliding the joint member 210 in the direction of the arrow in FIG. 2, the joint member 210 is connected to the joint surface 115 of the inkjet head 100. Since the two positioning pins 211 and 212 are longer than the joint needles 213, as described above, they are fitted in the two positioning openings 111 and 112 of the inkjet head 100 before the joint needles 213 reach the joint openings 113 of the inkjet head 100. This allows the joint openings 113 of the inkjet head 100 to be properly aligned with the joint needles 213 of the joint member 210. By sliding the joint member 210 in this state, the joint needles 213 break through the joint film 160 and enter the joint openings 113, thereby forming ink flow passages that communicate between the ink supply tubes 230 and the inkjet head 100. As illustrated in FIG. 3C, the components are pressed against diagonally shaded portions of the needle seals 133 to deform the needle seals 133, whereby the joint openings 113 are sealed closely.

The second positioning opening 111 and the second positioning pin 211 are fitted to form a second positioning portion, and the first positioning opening 112 and the first positioning pin 212 are fitted to form a first positioning portion.

If the accuracy of relative positioning of the joint openings 113 and the joint needles 213 using the first positioning portion and the second positioning portion is insufficient, the pressing contacts between the needle seals 133 and the joint needles 213 may become insufficient. In this case, ink may leak from the insufficient contact portions. In the present invention, below-described arrangement of the positioning portions (positioning openings and positioning pins) and the joint portions (joint openings and joint needles) allow the relative positions between the joint openings and the joint needles to be determined accurately. This reduces the risk of ink leakage at the joint portions.

In the first embodiment, the joint needles 213 of the joint member 210 are inserted in the joint openings 113 of the inkjet head 100. However, it is satisfactory as long as one of the inkjet head 100 and the joint member 210 has joint openings and the other has joint needles. Similarly, it is satisfactory as long as one of the inkjet head 100 and the joint member 210 has positioning openings and the other has positioning pins serving as projections.

Next, the arrangement of the positioning portions and the joint portions will be described in detail.

The following description will be given only with reference to the schematic view of the inkjet head 100, and not with reference to the view of the joint member 210. As described above, the joint member 210 has the joint needles 213 at the positions corresponding to the joint openings 113 and the second positioning pin 211 and the first positioning pin 212 at the positions corresponding to the second positioning opening 111 and the first positioning opening 112.

Figure 4A:
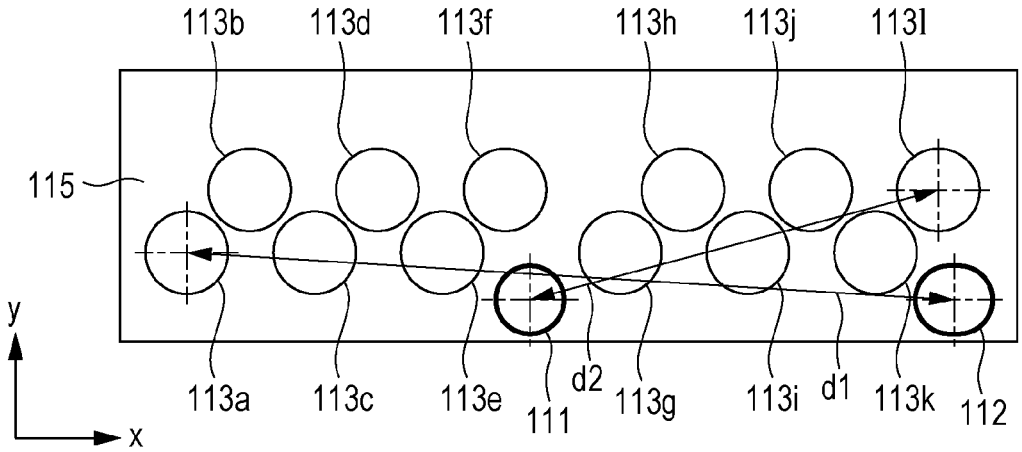
FIGS. 4A and 4B schematically illustrate the arrangement of joint openings and positioning openings in the first embodiment.
Figure 4B:
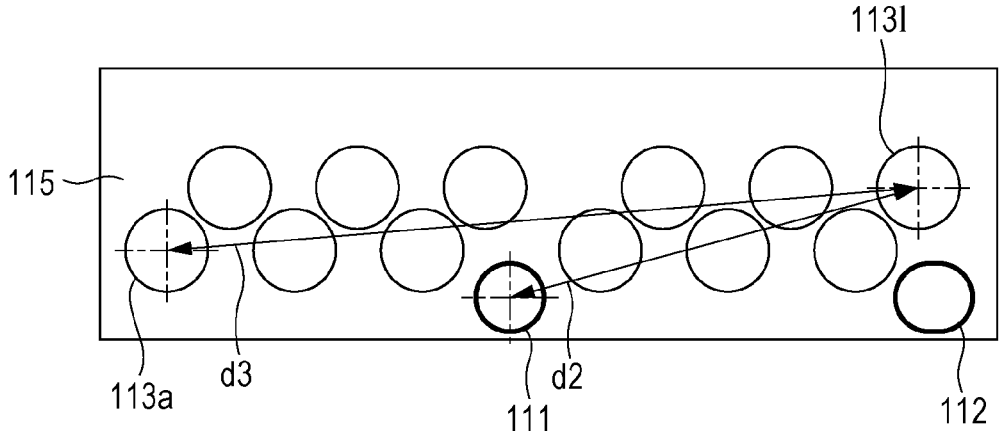

FIGS. 4A and 4B schematically illustrate the arrangement of the joint openings 113 (113*a* to 113*l*) and the two positioning openings 111 and 112 on the joint surface 115 of the tank holder 110. The twelve joint openings 113 (113*a* to 113*l*) are staggered in two upper and lower rows in the figures. Further, the second positioning opening 111 and the first positioning opening 112 are arranged such that a straight line connecting the second positioning opening 111 and the first positioning opening 112 extends along the arrangement direction of the joint openings 113. The arrangement of the joint openings 113, the second positioning opening 111, and the first positioning opening 112 is not limited to the above.

The function of the first positioning portion and the function second positioning portion will now be described.

As described above, the second positioning opening 111 is a circular hole, and is fitted on the positioning pin 211 provided on the joint member 210, which is similar in diameter to the second positioning opening 111. This aids in determining the relative position between the joint surface 115 of the inkjet head 100 and the joint member 210 in one of the directions along the joint surface 115 and the other direction being generally perpendicular thereto (y- and x-directions in FIG. 4A). The first positioning opening 112 may be a slotted hole that may be long in the x-direction of FIG. 4A, and is fitted on the first positioning pin 212 having a diameter substantially equal to the minor diameter of the slotted hole. This can determine the relative position between the joint surface 115 of the inkjet head 100 and the joint member 210 in the one of the directions along the joint surface 115 (y-direction in FIG. 4A).

Therefore, the first positioning portion and the second positioning portion can determine the relative positions between the joint openings 113 and the joint needles 213 in the direction of rotation on the second positioning portion.

Preferably, the first positioning opening 112 may be located such that the direction of the straight line connecting the second positioning opening 111 and the first positioning opening 112 coincides with the direction of the major diameter of the first positioning opening 112. This at least allows the relative positions between the joint openings 113 and the joint needles 213 in the direction of rotation on the second positioning portion to be determined with little to no influence of dimensional tolerance of the relative position between the first positioning portion and the second positioning portion. It may be only necessary that the first positioning opening 112 is long in one direction of the joint surface 115, and the direction of the major diameter is not limited.

When the relative positions between the joint openings 113 and the joint needles 213 are determined by the first positioning portion and the second positioning portion, the positions of the joint openings 113 and the joint needles 213 with reference to the second positioning portion may be determined by the following two factors:

(1) the distance from the second positioning portion; and (2) the position in the direction of rotation on the second positioning portion.

Hereinafter, the term "rotating direction" refers to the direction of rotation on the second positioning portion, unless otherwise specified.

If positional deviation of the joint openings 113 and the joint needles 213 relative to the positioning portion occurs, the accuracy in determining the relative positions between the joint openings 113 and the joint needles 213 decreases. Accordingly, in conjunction with the above two factors, causes of positional deviation of the joint openings 113 and the joint needles 213, and a structure that suppresses positional deviation for higher-precision positioning will be described. While positioning of the joint openings 113 will be described below, this also applies to positioning of the joint needles 213.

First, positional deviation of each joint opening 113 relative to the second positioning portion in the distance direction increases as the distance therebetween increases. This is because the dimensional tolerance increases as the distance increases. Therefore, to suppress positional deviation of the joint opening 113 relative to the second positioning portion in the distance direction, it is preferable that the distance between the joint opening 113 and the second positioning portion should be short. That is, it is preferable that a distance d2 between the second positioning opening 111 and the joint opening 113 farthest from the second positioning opening 111, of the joint openings 113, should be short.

Next, a description will be given of some of the known causes of positional deviation of the joint opening 113 in the direction of rotation on the second positioning portion. The following three factors are given:

(1) dimensional tolerance of the joint opening 113 itself in the rotating direction;

(2) a backlash in the first positioning portion;

(3) dimensional tolerance of the first positioning portion in the rotating direction.

Positional deviation due to the dimensional tolerance of the joint opening 113 itself in the rotating direction can increases as the distance between the second positioning portion and the joint opening 113 increases, for a reason similar to that for the positional deviation in the distance direction. From this, it is preferable that the distance d2 should be short, in order to suppress or reduce positional deviation of the joint opening 113 in the rotating direction resulting from the dimensional tolerance of the joint opening 113 itself in the rotation direction.

Figure 5A:
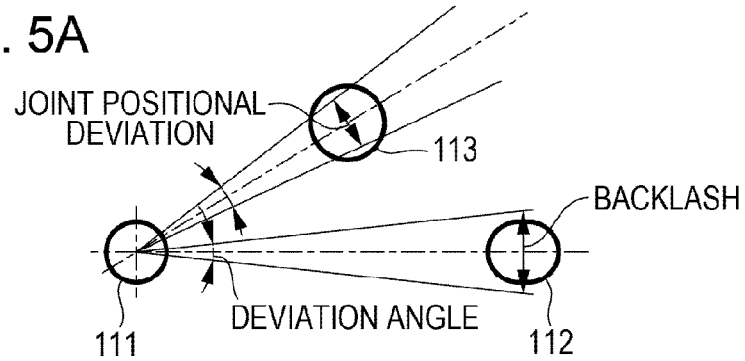
Figure 5A:
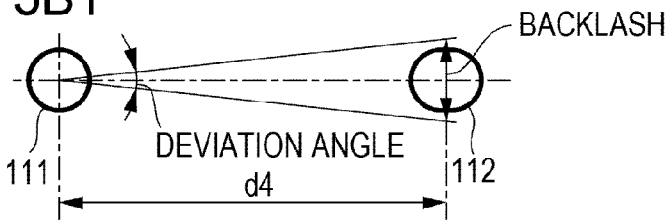
Figure 5A:
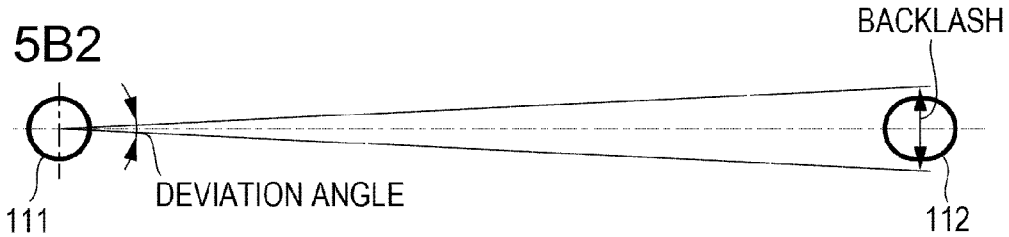
Figure 5A:
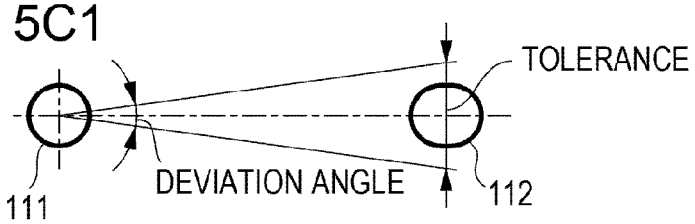
Figure 5A:
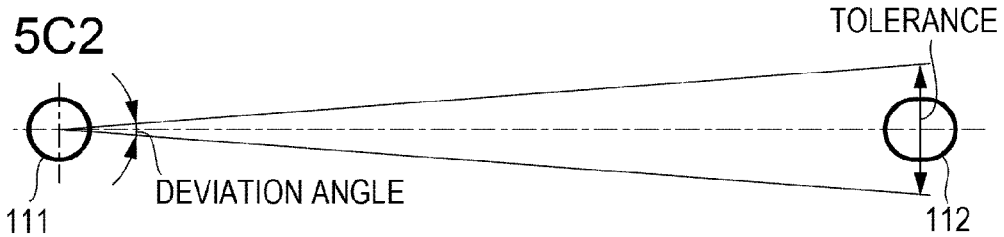

Next, a backlash in the first positioning portion is caused by the difference between the minor diameter of the first positioning opening 112 and the diameter of the first positioning pin 212. As illustrated in FIG. 5A, this backlash causes positional deviation of the joint opening 113 in the direction of rotation on the second positioning portion (the second positioning opening 111 is illustrated in this figure). Since the backlash may be fixed regardless of the position of the first positioning portion, the angle corresponding to the backlash decreases as a distance d4 between the second positioning opening 111 and the first positioning opening 112 increases, as illustrated in FIGS. 5B1 and 5B2. Further, as the distance d2 decreases, positional deviation of the joint opening 113 in the rotating direction in conjunction with the angle corresponding to the backlash may decrease. From this, it is preferable that the distance d4 should be long and the distance d2 should be short, in order to suppress positional deviation of the joint opening 113 in the rotating direction resulting from the backlash in the first positioning portion. As used herein, "long" and "short" are relative terms and a general relation between the terms can be inferred from at least FIGS. 4A, 4B and 5B1.

Although the dimensional tolerance of the first positioning portion in the rotating direction increases as the distance d4 increases, the distance d4 may be long because the increase rate of the tolerance is generally lower than the increase rate of the distance. Moreover, as illustrated in FIGS. 5C1 and 5C2, as the distance d4 increases, the angle of deviation relative to the second positioning portion (the second positioning opening 111 is illustrated in the figures) corresponding to the dimensional tolerance of the first positioning portion in the rotating direction decreases. From this, it is considered this structure is similar to the structure for suppressing positional deviation due to the backlash. That is, to suppress positional deviation of the joint opening 113 in the direction of rotation on the second positioning portion, which results from the dimensional tolerance of the first positioning portion in the rotating direction, it is preferable that the distance d2 should be short and the distance d4 should be long.

Accordingly, in the first embodiment, the positional accuracy of the joint opening 113 in the rotating direction is ensured by setting a sufficient distance d4 between the second positioning opening 111 and the first positioning opening 112.

When the joint openings 113 are arranged in a wide area, if a sufficient consideration is not given to the arrangement of the positioning portions with respect to the joint openings 113, the distance d2 may become long. As described above, when the distance d2 is long, positional deviation of the joint openings 113 easily occurs, and this may reduce the positional accuracy. Hence, it is necessary to properly place the positioning portions with respect to the joint openings 113. Particularly when the number of joint openings 113 is large, the area where the joint openings 113 are arranged is wide, and therefore, it is necessary to sufficiently consider the arrangement of the positioning portions.

Accordingly, in the first embodiment, as illustrated in FIG. 4A, the second positioning opening 111 and the first positioning opening 112, and the joint openings 113 (113*a* to 113*l*) are arranged such that the positional relationship thereamong satisfies a condition that d2<d1. As described above, the distance d2 refers to the distance between the second positioning opening 111 and the joint opening 113 farthest therefrom (113*l* in the first embodiment). The distance d1 refers to the distance between the first positioning opening 112 and the joint opening 113 farthest therefrom (113*a* in the first embodiment).

As described above, the distance d4 between the second positioning opening 111 and the first positioning opening 112 is set to be more than or equal to a predetermined distance sufficient to accurately position the joint openings 113 in the rotating direction. Therefore, the distances between the second positioning opening 111 and the joint openings 113 needs to be short while the distance d4 between the second positioning opening 111 and the first positioning opening 112 is greater than or equal to the predetermined distance.

For that purpose, the two positioning openings 111 and 112 and the joint openings 113 are arranged such that the distance d2 between the second positioning opening 111, which need to be at short distances from the joint openings 113, and the farthest joint opening 113*l* is shorter than the distance d1. That is, the midpoint between the second positioning opening 111 and the first positioning opening 112 is shifted to one side in a longitudinal direction of the arrangement area, where the joint openings 113 are arranged, from the center of the arrangement area. This allows the distances between the second positioning opening 111 and the joint openings 113 to be short while ensuring a sufficient distance d4 between the second positioning opening 111 and the first positioning opening 112. For this reason, positional deviation of the joint openings 113 relative to the second positioning portion can be suppressed, and the relative positions between the joint openings 113 and the joint needles 213 can be determined accurately. Therefore, it is possible to reduce the risk of link leakage from the joint portions where the joint openings 113 and the joint needles 213 are fitted together.

A description will be given below of a condition for more accurately positioning the joint openings 113 while the above condition that d2<d1 is satisfied. The present invention is not limited only to the case that satisfies the following condition.

As illustrated in FIG. 4B, in the first embodiment, the positional relationship between the second positioning opening 111 and the joint openings 113 satisfies a condition that d2<d3. Here, the distance d3 refers to the longest one of the distances between the joint openings 113. Since the distance d2 can be further shortened by satisfying the condition that d2<d3, positional deviation of the joint openings 113 relative to the second positioning portion can be further suppressed, and the relative positions between the joint openings 113 and the joint needles 213 can be determined more accurately.

In the first embodiment, the second positioning opening 111 is located near the center of the joint portion area, where the joint openings 113 are arranged, in the arrangement direction of the joint openings 113. In the structure including a plurality of joint openings 113, the distance d2 is shortest when the second positioning opening 111 is located at the center of a circle having the smallest diameter, of circles that can include all joint openings 113. For this reason, by placing the second positioning opening 111 near the center of the joint portion area, the distance d2 can be minimized in the structure having the joint portion area that is long in one direction. This can further suppress positional deviation of the joint openings 113 relative to the second positioning portion.

In the first embodiment, the first positioning opening 112 is located near an end of the joint portion area in the arrangement direction of the joint openings 113. This ensures a long distance d4 between the second positioning opening 111 and the first positioning opening 112, and suppresses positional deviation of the joint openings 113 in the rotating direction. Further, since the first positioning opening 112 is located near the end of the joint portion area, a space where the joint openings 113 and the positioning openings 111 and 112 are provided can be reduced.

Figure 6A:
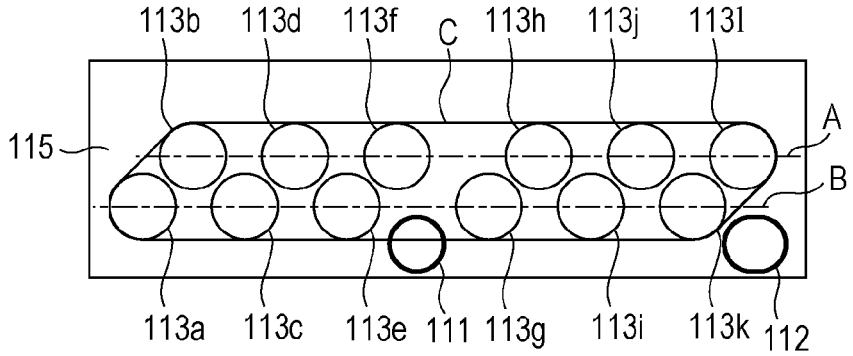
FIGS. 6A and 6B illustrate the arrangement of the joint openings and the positioning openings in the first embodiment.

In the first embodiment, as illustrated in FIG. 6A, the joint openings 113 are arranged on two generally parallel straight lines A and B. By thus arranging the joint openings 113 on at least one straight line, the joint portion area where the joint openings 113 are arranged can be reduced. This leads to size reduction of the inkjet head 100.

Further, the second positioning opening 111 is provided such that a part thereof is included in the joint portion area surrounding the joint openings 113 (area C in FIG. 6A). This arrangement can reduce the space where the joint openings 113 and the positioning openings 111 and 112 are provided. This may lead to a size reduction of the inkjet head 100.

Figure 6B:
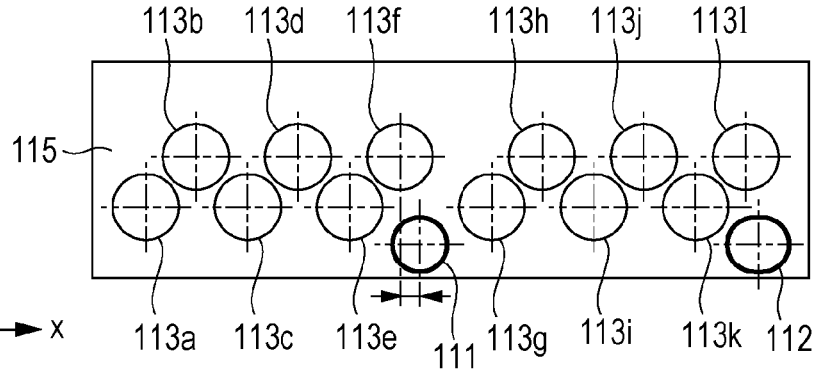

In addition, as illustrated in FIG. 6B, the joint opening 113 closest to the second positioning opening 111 in the x-direction is different from the joint opening 113 closest to the second positioning opening 111 in the y-direction. Here, the x-direction refers to the direction in which the joint openings 113 are arranged, and the y-direction refers to the direction perpendicular to the x-direction in the joint surface 115. In the first embodiment, the joint opening 113*f* is the closest to the second positioning opening 111 in the x-direction, and the joint openings 113*a*, 113*c*, 113*e*, 113*g*, 113*i*, and 113*k* are the closest to the second positioning opening 111 in the y-direction. By arranging the joint openings 113 on a plurality of straight lines in the above-described manner, the space where the joint openings 113 and the positioning openings 111 and 112 are provided can be further reduced, and this further may lead to a size reduction of the inkjet head 100.

Figure 6C:
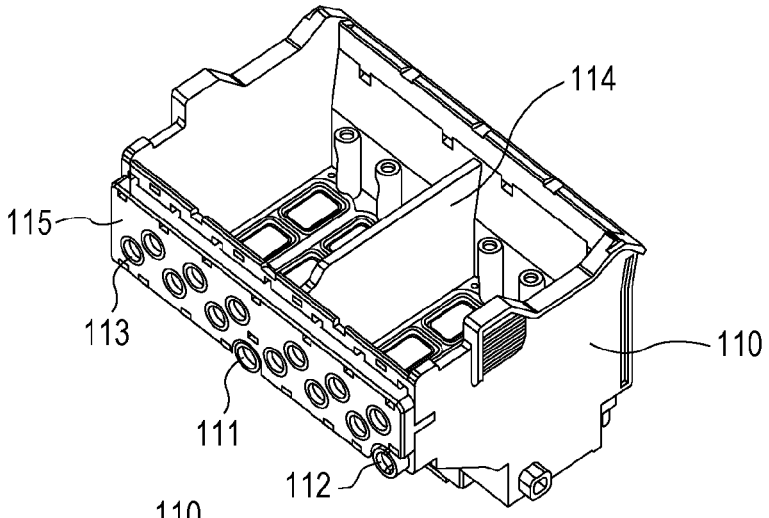
FIGS. 6C and 6D are perspective views of the tank holder.
Figure 6D:
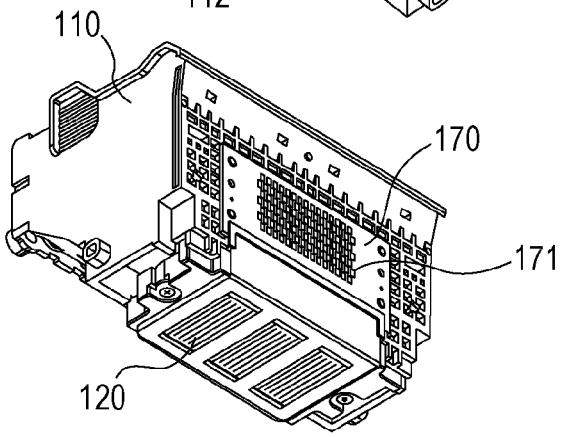

FIG. 6C is a perspective view illustrating the tank holder 110 including the joint surface 115 to be connected to the joint member 210, in which the sub-tanks 150 are not mounted. In the tank holder 110, the sub-tanks 150 are not mounted. FIG. 6D is a perspective view of the tank holder 110 including a surface on which an electric wiring board 170 is provided.

In the first embodiment, a rib 114 is provided in the center of a back surface of the joint surface 115 in the arrangement direction of the joint openings 113. The rib 114 extends in a direction intersecting the joint surface 115. When the inkjet head 100 is mounted in the inkjet recording apparatus, an electrical connection pad 171 provided on the electric wiring board 170 of the inkjet head 100 is electrically connected to a connector (not illustrated) provided in the inkjet recording apparatus by contact therewith. The connector presses the electrical connection pad 171 hard so as to make a reliable contact therebetween. Therefore, the tank holder 110 receives reaction force from the connector. If the reaction force is large, the risk of deformation of the tank holder 110 may increase. Accordingly, the rib 114 is provided in the tank holder 110 and may be perpendicular to the surface of the tank holder 110 having the electric wiring board 170, as described above. This can reduce the risk of deformation of the tank holder 110.

As described above, the joint openings 113 are provided at the positions opposing the sub-tanks 150 connected to the tank holder 110 (see FIG. 2). For this reason, in a portion where the rib 114 is provided, the distance between the two adjacent joint openings 113 (distance between the joint opening 113*f* and the joint opening 113*g* in the first embodiment) is longer than the distance between the other joint openings 113. Here, the distance between the joint openings 113 refers to the shortest distance between the joint openings 113.

Accordingly, in the first embodiment, the second positioning opening 111 is provided in the portion where the distance between the two adjacent joint openings 113 is longer than the distance between the other joint openings 113. That is, the second positioning opening 111 is provided in a free space where the joint openings 113 are not provided, and therefore, the space where the joint openings 113 and the positioning openings 111 and 112 are provided can be reduced further.

Second Embodiment

A second embodiment of the present invention will be described below. Descriptions of structures similar to those adopted in the first embodiment are skipped, and a description will be given of the arrangement of joint portions and positioning portions that is characteristic of the present invention.

Figure 8:
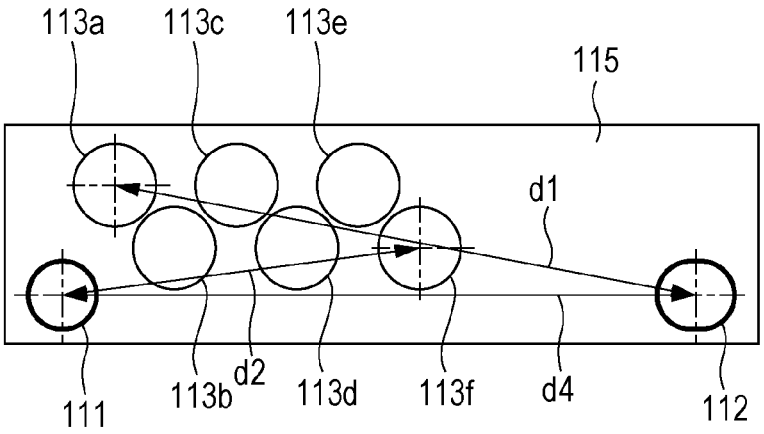
FIG. 8 schematically illustrates the arrangement of joint openings and positioning openings in a second embodiment of the present invention.

FIG. 8 schematically illustrates the arrangement of joint openings 113, a second positioning opening 111, and a first positioning opening 112 in the second embodiment. The second embodiment satisfies a condition that d2<d1, similarly to the first embodiment. This at least allows the distances between the second positioning opening 111 and the joint openings 113 to be shortened while ensuring a sufficient distance d4 between the second positioning opening 111 and the first positioning opening 112. For this reason, positional deviation of the joint openings 113 relative to a second positioning portion can be suppressed or reduced, and the relative positions between the joint openings 113 and joint needles 213 can be determined accurately.

Further, the arrangement of the second embodiment satisfies a condition that d2<d4. Hence, the amount of positional deviation of the joint openings 113 in the rotating direction resulting from a backlash in a first positioning portion and the dimensional tolerance of the first positioning portion in the rotating direction can be made smaller than the amount of positional deviation caused in the first positioning portion.

In addition, in the second embodiment, the joint openings 113 are arranged within an area between the second positioning opening 111 and the first positioning opening 112. That is, the width of an area of the joint openings 113 and the two positioning openings 111 and 112 in the arrangement direction of the joint openings 113 is determined by the distance d4 between the second positioning opening 111 and the first positioning opening 112. Therefore, the area of the joint openings 113 and the positioning openings 111 and 112 can be narrowed while ensuring a predetermined accuracy for the relative positions between the joint openings 113 and the joint needles 213.

Third Embodiment

A third embodiment of the present invention will be described below. Descriptions of structures similar to those adopted in the first embodiment are skipped, and a description will be given of the arrangement of joint portions and positioning portions that is characteristic of the present invention.

Figure 9:
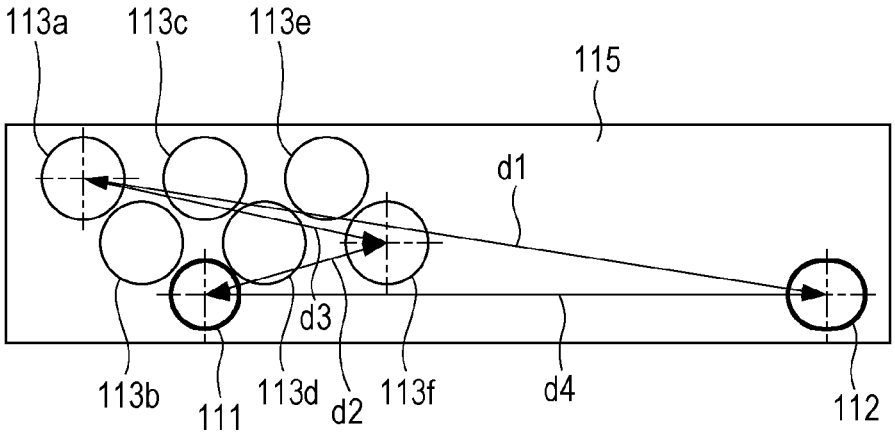
FIG. 9 schematically illustrates the arrangement of joint openings and positioning openings in a third embodiment of the present invention.
Figure 10:
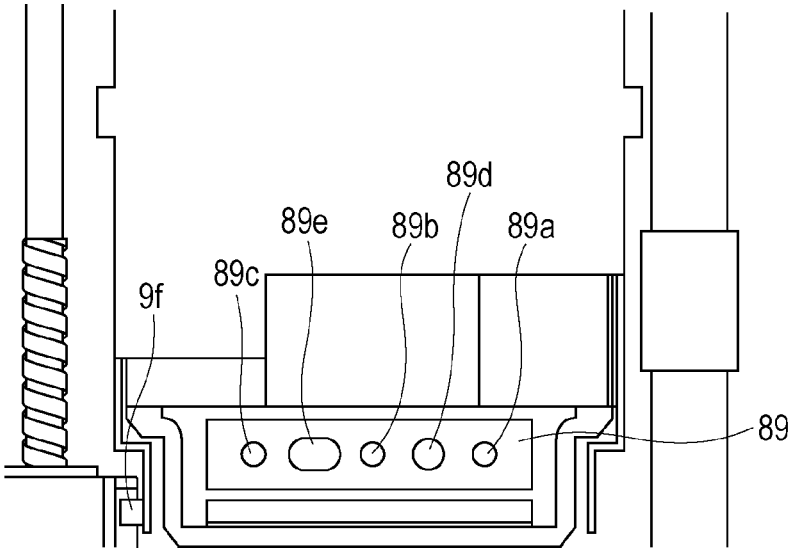
FIG. 10 illustrates the arrangement of positioning portions in the related art.

FIG. 9 schematically illustrates the arrangement of joint openings 113, a second positioning opening 111, and a first positioning opening 112 in the third embodiment. In the third embodiment, the arrangement satisfies a condition that d2<d1 and d2<d3 and a condition that d2<d4. Since this can make the distance d2 shorter than in the second embodiment, positional deviation of the joint openings 113 relative to a second positioning portion can be suppressed or reduced, and the relative positions between the joint openings 113 and joint needles 213 can be determined accurately.

In the above-described embodiments, the distances d1 to d4 refer to the distances between the centers of gravity of the second positioning opening 111, the first positioning opening 112, and the joint openings 113 in the directions along the joint surface 115.

In the above-described embodiments, the relationships among the distances d1 to d4 have been described in conjunction with the joint surface 115 of the inkjet head 100. On the joint member 210 side, however, the second positioning pin 211, the first positioning pin 212, and the joint needles 213 are provided at the positions corresponding to the second positioning opening 111, the first positioning opening 112, and the joint openings 113, respectively. Therefore, the above-described relationships among the distances d1 to d4 also apply to the joint member 210.

Figure 7A:
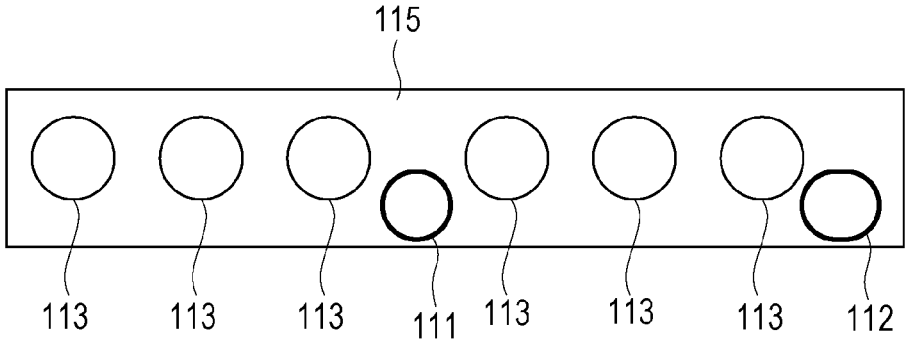
FIGS. 7A and 7B illustrate modifications of the first embodiment.
Figure 7B:
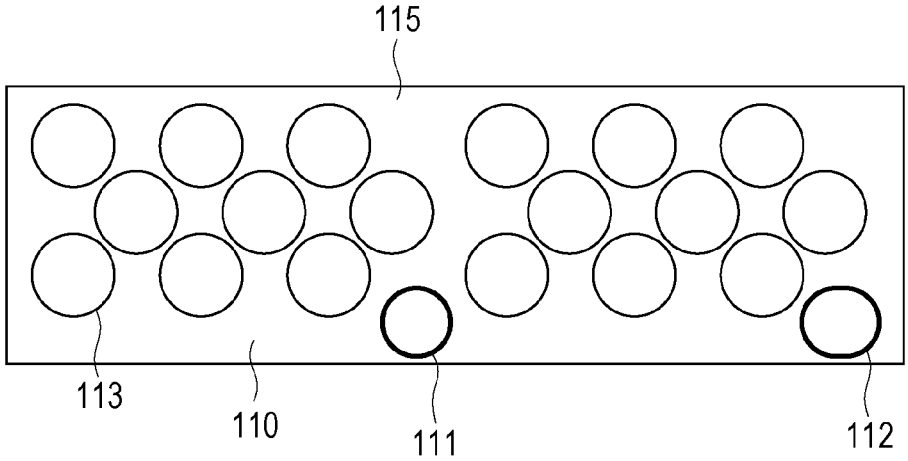

While the joint openings 113 are arranged in two rows in the above-described embodiments, they may be arranged in one row or in three or more rows, as illustrated in FIGS. 7A and 7B.

As in the above-described first to third embodiments, the second positioning opening 111, the first positioning opening 112, and the joint openings 113 can be arranged according to the required conditions such as space and positioning accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-189455 filed Aug. 26, 2010, which is hereby incorporated by reference herein in its entirety.

What is claimed is:

1. A liquid ejection apparatus, comprising:

a liquid passage member having a plurality of liquid passages;

a connecting surface having a plurality of connecting portions connected to the plurality of liquid passages;

a first positioning portion of a slotted hole configured to determine relative positions between the plurality of liquid passages and the plurality of connecting portions in one direction along the connecting surface, the first positioning portion being provided on the connecting surface; and a second positioning of a slotted hole portion configured to determine relative positions between the plurality of liquid passages and the plurality of connecting portions in the one direction and another direction perpendicular to the one direction, along the connecting surface, the second positioning portion being provided on the connecting surface, wherein a first distance between a weight center of gravity of the first positioning portion in a direction in a plane parallel to the connecting surface and along the connecting surface and a weight center of gravity of the connecting portion in the direction along the connecting surface, farthest from the first positioning portion, is longer than a second distance between a weight center of gravity of the second positioning portion in the direction along the connecting surface and a weight center of gravity of the connecting portion in the direction along the connecting surface, farthest from the second positioning portion.

2. The liquid ejection apparatus according to claim 1, wherein the second distance is shorter than a third distance between centers of gravity of the connecting portions in the direction along the connecting surface, and farthest from each other of the plurality of connecting portions.

3. The liquid ejection apparatus according to claim 1, wherein the second positioning portion is located near a center portion of an area where the plurality of connecting portions is provided in an arrangement direction in which the plurality of connecting portions are arranged.

4. The liquid ejection apparatus according to claim 3, wherein the first positioning portion is located near an end of the area in the arrangement direction.

5. The liquid ejection apparatus according to claim 1, wherein the second distance is shorter than a fourth distance, the fourth distance being between the center of gravity of the first positioning portion and the center of gravity of the second positioning portion.

6. The liquid ejection apparatus according to claim 1, wherein the second positioning portion and at least one of the plurality of connecting portions overlap with each other in an arrangement direction in which the plurality of connecting portions are arranged.

7. The liquid ejection apparatus according to claim 1, wherein the plurality of connecting portions are arranged on a plurality of generally parallel and straight lines in the direction along the connecting surface, and wherein the connecting portion having a center of gravity closest to the center of gravity of the second positioning portion in an arrangement direction in which the plurality of connecting portions are arranged is different from the connecting portion having a center of gravity closest to the center of gravity of the second positioning portion in a direction perpendicular to the arrangement direction in the direction along the connecting surface.

8. The liquid ejection apparatus according to claim 1, wherein a direction in which the plurality of connecting portions are arranged is along a straight line connecting the first positioning portion and the second positioning portion in the direction along the connecting surface.

9. The liquid ejection apparatus according to claim 1, wherein the first positioning portion determines the relative positions in the one direction by a first opening provided in one of the liquid member and the connecting surface and a first projection provided on the other, the first opening and the first projection being fitted together such as to be in contact with each other in the one direction and such as not to be in contact with each other in the other direction, and wherein the second positioning portion determines the relative positions in the one direction and the other direction by a second opening provided in one of the liquid passage member and the connecting surface and a second projection provided on the other, the second opening and the second projection being fitted together such as to be in contact with each other in the one direction and the other direction.

10. The liquid ejection apparatus according to claim 1, wherein the relative positions are determined by the first positioning portion and the second positioning portion before the plurality of liquid passages are connected to the plurality of connecting portions.

11. The liquid ejection apparatus according to claim 1, wherein the second positioning portion is located in a portion where a distance between the adjacent connecting portions in an arrangement direction in which the plurality of connecting portions are arranged is longer than other portions.

12. The liquid ejection apparatus according to claim 11, wherein a rib extending in a direction intersecting the connecting surface is provided on a back side of the portion.

13. A liquid ejection head, comprising:

a connecting surface having a plurality of connecting portions connected to a plurality of liquid passages provided in a liquid passage member, wherein the connecting surface comprises:

a first positioning portion of a slotted hole fitted in a first positioning portion provided in the liquid passage member so as to determine relative positions between the plurality of liquid passages and the plurality of connecting portions in one direction of directions along the connecting surface, the first positioning portion being provided on the connecting surface, and a second positioning portion of a slotted hole fitted in a second positioning portion provided in the liquid passage member so as to determine relative positions between the plurality of liquid passages and the plurality of connecting portions in the one direction and the other direction perpendicular to the one direction, of the directions along the connecting surface, the second positioning portion being provided on the connecting surface, and wherein a first distance between a weight center of gravity of the first positioning portion of the connecting surface in a direction in a plane parallel to the connecting surface and along the connecting surface and a weight center of gravity of the connecting portion in the direction along the connecting surface, farthest from the first positioning portion of the connecting surface is longer than a second distance between a weight center of gravity of the second positioning portion of the connecting surface in the direction along the connecting surface and a weight center of gravity of the connecting portion in the direction along the connecting surface, farthest from the second positioning portion of the connecting surface.

14. The liquid ejection head according to claim 13, wherein the second distance is shorter than a third distance between centers of gravity of the connecting portions in the direction along the connecting surface, farthest from each other of the plurality of connecting portions.

15. The liquid ejection head according to claim 13, wherein the second positioning portion is located near a center portion of an area where the plurality of connecting portions are provided in an arrangement direction in which the plurality of connecting portions are arranged.

16. The liquid ejection head according to claim 15, wherein the first positioning portion is located near an end of the area in the arrangement direction.

17. The liquid ejection apparatus according to claim 1, wherein the first positioning portion includes a first opening and a first projection being fitted with the first opening, wherein the second positioning portion includes a second opening and a second projection being fitted with the second opening, and wherein the first opening is elongate in the other direction and the second opening is circular.

18. The liquid ejection apparatus according to claim 1, wherein the first positioning portion includes a first opening and a first projection being fitted with the first opening, wherein the second positioning portion includes a second opening and a second projection being fitted with the second opening, and wherein a space between the first opening and the first projection in the other direction is larger than a space between the second opening and second projection in the other direction.

19. The liquid ejection apparatus according to claim 1, wherein the plurality of liquid passages supply liquid to be ejected from the liquid ejection apparatus.

* * * * *